US006382625B1

(12) United States Patent
Chang

(10) Patent No.: US 6,382,625 B1
(45) Date of Patent: May 7, 2002

(54) COMBINATION PUZZLE AND PRODUCT HOLDER

(75) Inventor: Eddie Chang, Kowloon (HK)

(73) Assignee: Man Nin Shing Company Limited (HK)

( * ) Notice: Subject to any disclaimer, the term of this patent is extended or adjusted under 35 U.S.C. 154(b) by 0 days.

(21) Appl. No.: 09/633,130

(22) Filed: Aug. 4, 2000

(51) Int. Cl.[7] ..... A63F 9/08
(52) U.S. Cl. ..... 273/160; 273/157 R
(58) Field of Search ..... 273/153 R, 157 R, 273/156, 160

(56) References Cited

U.S. PATENT DOCUMENTS

D169,482 S * 5/1953 Henke et al. ..... 273/157 R
4,007,555 A * 2/1977 Sasaoka ..... 273/157 R
4,699,602 A * 10/1987 Giorgi ..... 273/157 R
5,405,135 A * 4/1995 Embro ..... 273/157 R
5,868,388 A * 2/1999 Wood et al. ..... 273/157 R

* cited by examiner

*Primary Examiner*—Steven Wong
(74) *Attorney, Agent, or Firm*—Jackson Walker L.L.P.

(57) ABSTRACT

A combination puzzle, a product holder and a method of making same having at least two H shaped pieces, at least two plus shaped pieces and at least one cubic piece. Each H shaped piece has a first and second vertical member perpendicularly attached to one another by a horizontal member extending between them. Interlocking spaces are defined in between the first and second vertical members above and below the horizontal member. Each plus shaped piece has a vertical plus member and two side members. The side members are connected to opposite sides of the vertical plus member and extend outwardly and perpendicularly from the vertical plus member. Four separate arms are formed by the vertical plus members and the two side members that can be interlocked with the interlocking spaces. The cubic clock piece has at least one face display and can be interlocked with the interlocking spaces and can be used as the cubic piece. These pieces can be assembled in a host of configurations such as a bird, a cube, or a W configuration.

19 Claims, 7 Drawing Sheets

COMBINATION PUZZLE AND PRODUCT HOLDER

BACKGROUND OF THE INVENTION

The present invention relates to puzzles and to product holders, more particularly to a combination puzzle and product holder capable of being assembled into particular configurations, each configuration acting as an ornamental product holder.

The prior art consists of various types of puzzles as well as various product holders. The prior art describes flat puzzles that form pictures upon assembly as well as puzzles that form three dimensional buildings and structures upon assembly. The prior art describes cylindrical and rectangular paper clip holders, plastic dispensers for office supplies, and large wooden frames for displaying books and pictures. The prior art puzzles and product holders limit the user to one particular configuration. Thus the attraction of the product to the consumer fades once the puzzle or product holder has been assembled for the first time.

SUMMARY OF THE INVENTION

Accordingly, the present invention provides a combination puzzle and product holder having pieces made of elastic material that may be assembled into particular configurations such as a bird configuration, a W configuration, an M configuration, and a cube configuration. Each of these configurations are capable of ornamentally displaying various products as well as providing a challenging and entertaining puzzle to assemble.

DETAILED DESCRIPTION OF THE PREFERRED EMBODIMENT

The present invention is herein described as a combination puzzle, a product holder and a method of making same.

Figure 1:
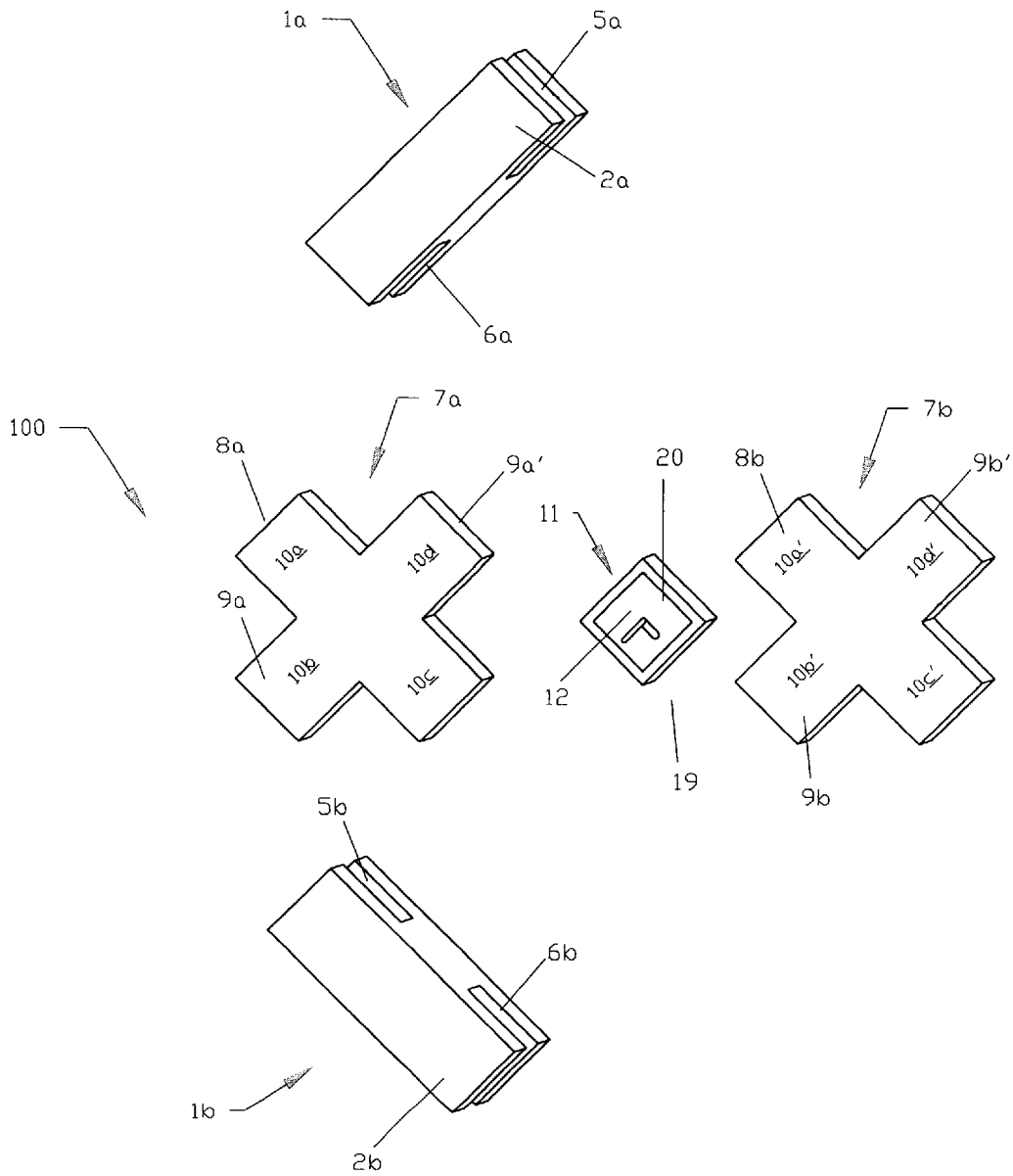
FIG. 1 is an exploded perspective view of the bird configuration of the present invention.
Figure 4:
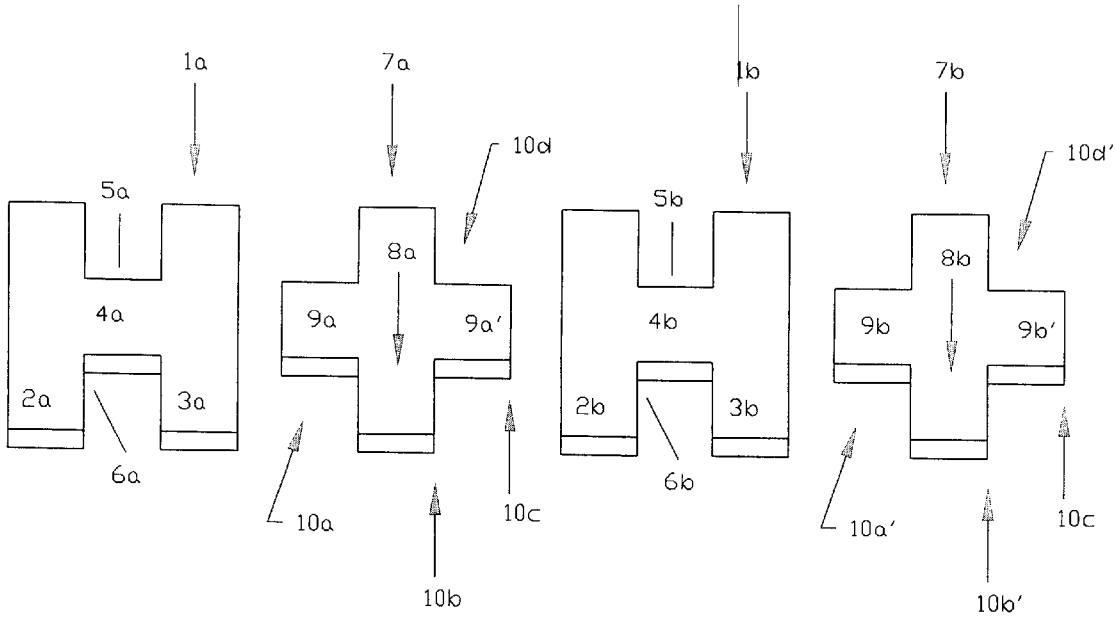
FIG. 4 is a side elevation view of two H shaped pieces and two plus shaped pieces of the present invention.

The combination puzzle (100) is illustrated in the FIGS. In FIGS. 1 and 4, the puzzle (100) has at least two H shaped pieces (1*a* and 1*b*). Each H shaped piece has a first and a second vertical member (2*a* and 2*b*, and 3*a* and 3*b* respectively). These vertical members are perpendicularly attached to one another by a horizontal member (4*a* and 4*b*) extending between them. Interlocking spaces (5*a* and 5*b*, and 6*a* and 6*b* respectively) are defined in between the first and second vertical members both above (5*a* and 5*b*) and below (6*a* and 6*b*) the horizontal member (4*a* and 4*b*).

The present invention has at least two plus shaped pieces 7*a* & 7*b* each having a vertical plus member (8*a* and 8*b*) and two side members (9*a* and 9*a*', and 9*b* and 9*b*' respectively). The side members are connected to opposite sides of the vertical plus member (8*a* and 8*b*), and extend outwardly and perpendicularly from the vertical plus member. Four separate arms (10*a* and 10*a*', 10*b* and 10*b*', and 10*c* and 10*c*', and 10*d* and 10*d*' respectively) are formed by the vertical plus members and two side members that are interlockable with the interlockable spaces (5*a* and 5*b*, and 6*a* and 6*b* respectively).

The present invention has at least one cubic piece (11) having at least one face display (12). In FIG. 1, the face display (12) is the hands of a clock. The cubic piece 11 is interlockable within the interlocking spaces (5*a* and 5*b*, and 6*b* and 6*b* respectively). The cubic piece 11 may be a cubic clock piece 20, an ornamental picture, or any other aesthetically pleasing item. The cubic clock piece being a cubic clock capable of fitting within the interlockable spaces (5*a* and 5*b*, and 6*a* and 6*b* respectively). The face display 12 may be a clock face to provide the user with an ornamental timepiece at work or at home.

Figure 1A:
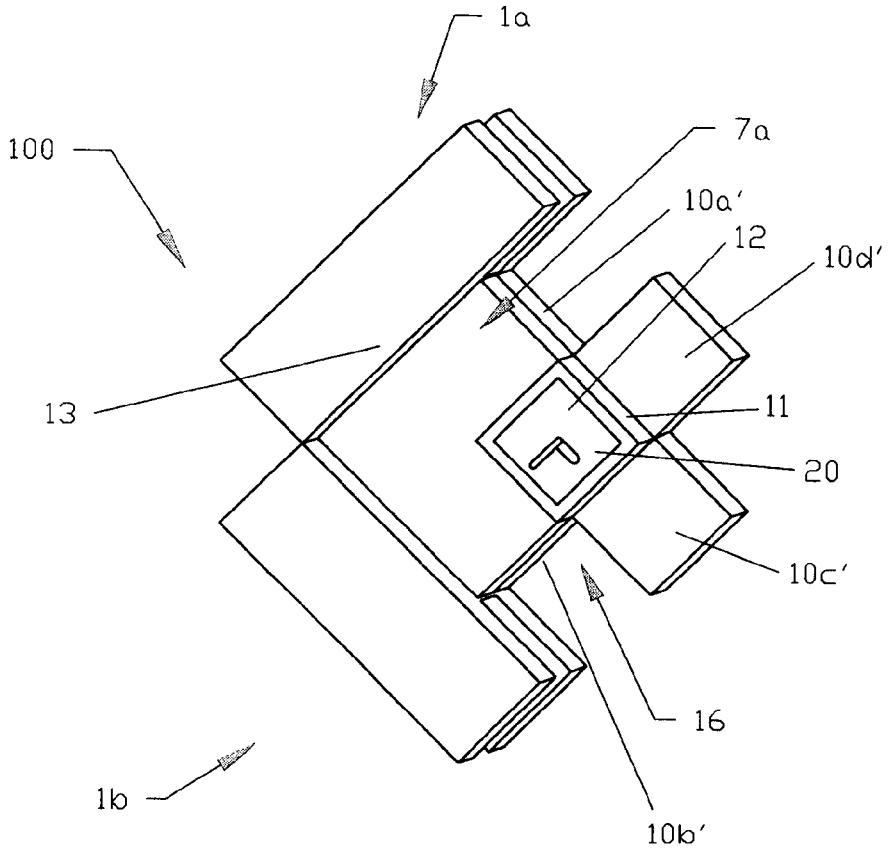
FIG. 1A is a perspective view of the assembled bird configuration of the present invention.
Figure 2:
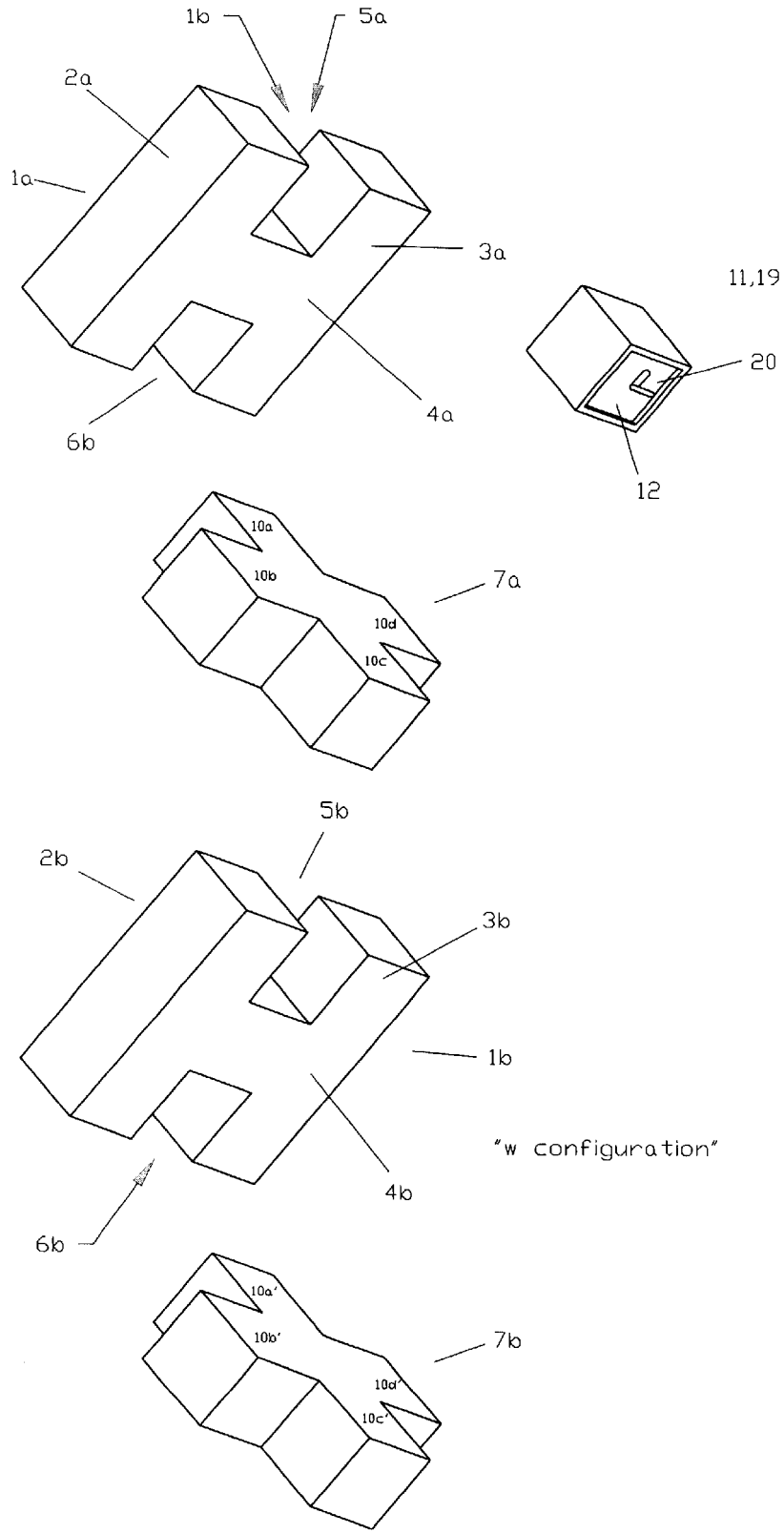
FIG. 2 is an exploded perspective view of the W or M configuration of the present invention.

FIG. 1A illustrates the assembled puzzle (100), in an abstract art type bird configuration (200). The wings of the bird are the H shaped pieces (1*a* and 1*b*). The body is made from the first plus shaped piece (7*a*) and the tail feathers are two arms of the plus shaped pieces (10*c* and 10*c*'). FIG. 1A also illustrates the cubic piece (11) with a visible face display (12) forming a part of the body and a cubic clock piece (20) inserted as the face display. FIG. 2 shows the puzzle piece in a pre-assembly configuration. FIG. 2 is an exploded perspective view.

Figure 2A:
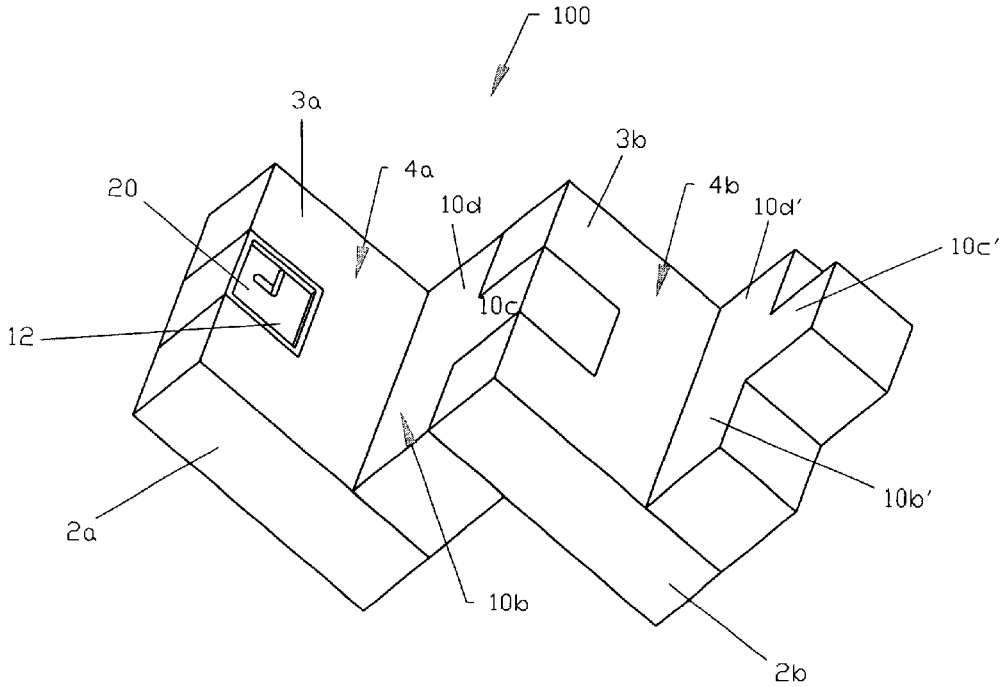
FIG. 2A is a top, right side, front perspective view of the W configuration of the present invention.

FIG. 2A illustrates the assembled puzzle (100) arranged in the W or M configuration (15). The W configuration of the combination puzzle and product holder may be assembled by following a few simple steps.

First, the cubic clock piece (20) is inserted into the space (5*a*) located above the horizontal member (4*a*) of the first H shaped piece (1*a*) so that the face display (12) of the cubic clock piece (20) is visible when the puzzle is properly oriented as discussed below. Second, a first arm (10*a*) of a first plus shaped piece (7*a*) is inserted perpendicularly into the space (6*b*) below the horizontal member (4*a*) of the first H shaped piece (1*a*). Third, the opposite arm (10*c*) of the first plus shaped piece (7*a*) is inserted into the space (5*b*) above the horizontal member (4*b*) of a second H shaped piece (7*b*) so that the second H shaped piece (1*b*) extends in a direction opposite to the direction of the first H shaped piece (1*a*).

The fourth step to assemble the W configuration (15) is to insert a first arm (10*c*') of a second plus shaped piece (7*b*) into the space (6*b*) below the horizontal member (4*b*) of the second H shaped piece (1*b*) so that the second H shaped piece (1*b*) extends in a direction opposite to the direction of the first plus shaped piece (7*a*). The assembled puzzle (100) is then oriented so that when placed on a generally horizontal surface like a desk top or shelf, the opposite arm (10*c*) of the first plus shaped piece (7*a*) is above the first arm (10*a*) of the first plus shaped piece (7*a*) thereby yielding a "W" shape.

Figure 2B:
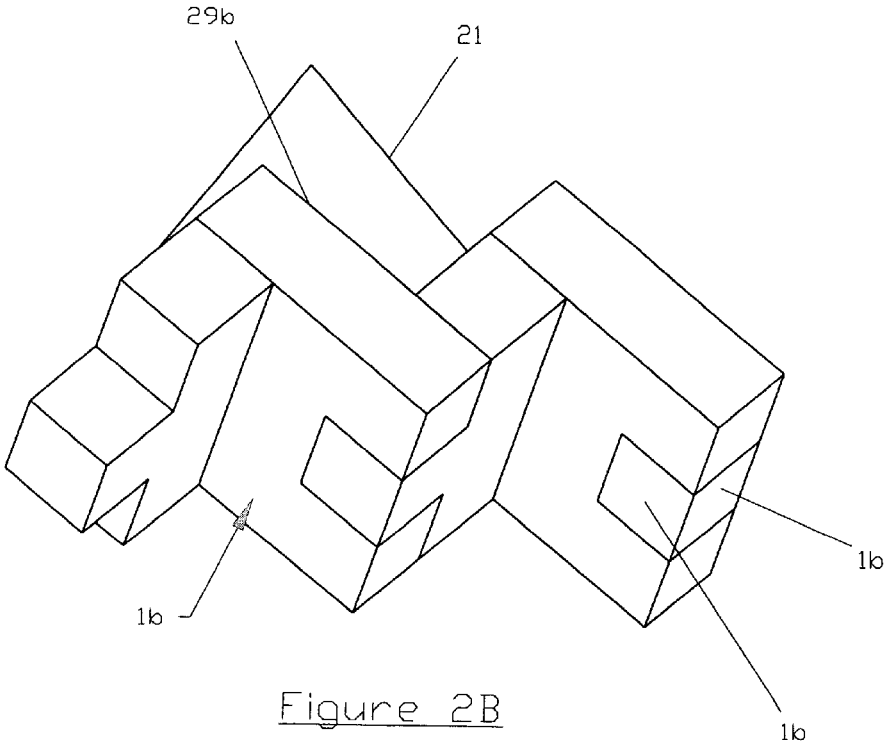
FIG. 2B is a bottom, right side, back perspective view with the clock face not shown and with information cards resting on the top surface of the M configuration of the present invention.
Figure 7:
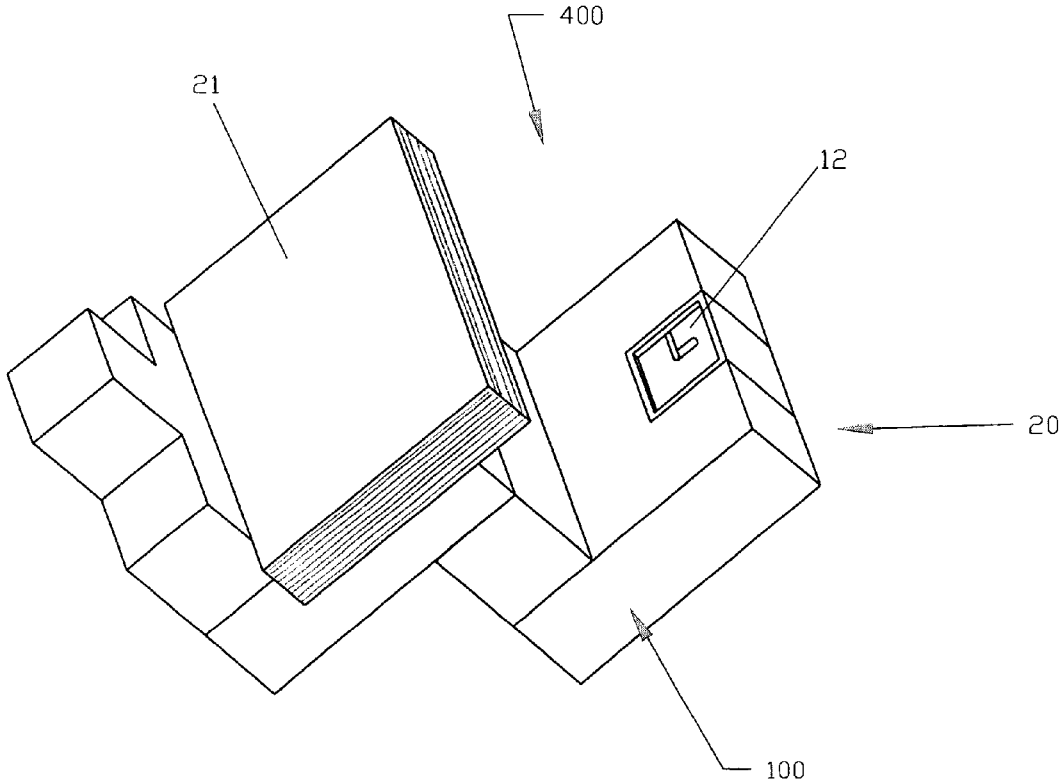
FIG. 7 is a perspective view of the W configuration of the present invention displaying an information card and a cubic clock piece.

After assembly, information cards (21) may be placed upon the combination to act as an attractive product holder FIGS. 2B and 7. A cubic clock piece (20) having at least one visible face display (12) can be used as the cubic piece (11). Both the cubic clock piece and the information cards may be displayed as a part of the combination.

It should be understood that by having the clock piece (20) inserted into space (5*a*) in an opposite direction to that described above and inverting the "W" orientation 180° will result in an "M" shaped configuration for the combination.

FIG. 2B shows the "M" configuration from the back and beneath the puzzle. The back side of the clock (20*b*) is shown. The face (not shown) is on the opposite side. Information cards (21) and shown placed on a top surface (29*b*) of H piece (1*b*).

Figure 3A:
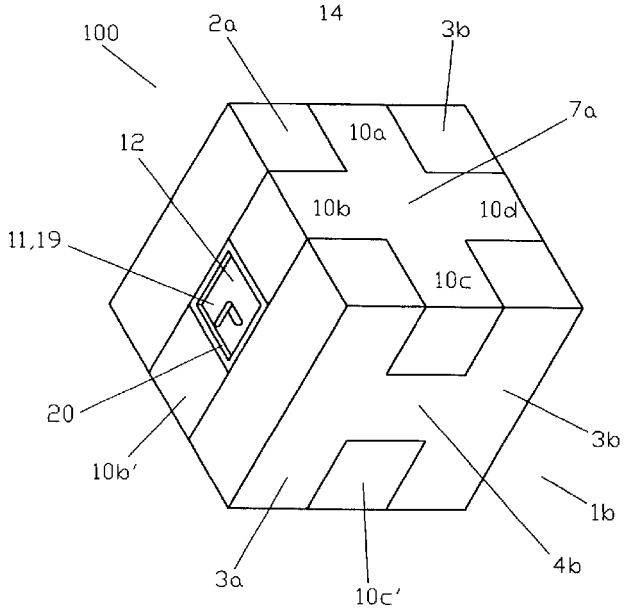
FIG. 3A is a perspective view of the assembled cube configuration of the present invention.

FIG. 3A illustrates the assembled puzzle (100) in a cubic configuration (14).

Figure 3:
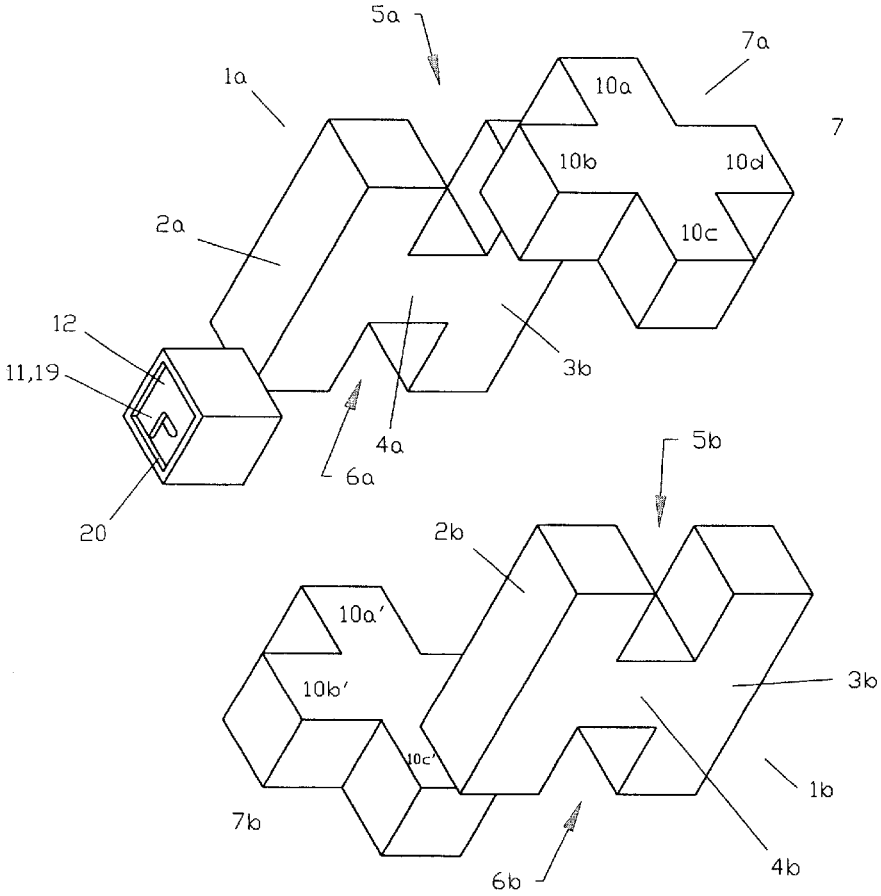
FIG. 3 is an exploded perspective view of the cube configuration of the present invention.

FIG. 3 illustrates two H shaped pieces (1*a* and 1*b*), two plus shaped pieces (7*a* and 7*b*), and a cubic piece (11) having a face display (12) in an exploded perspective view before assembly into another configuration. FIG. 3 illustrates the face display (12) as being the hands of a clock.

To assemble the embodiment on FIG. 3A, perpendicularly insert a first arm (10*a*) of a first plus shaped piece (7*a*) into the space (5*a*) above the horizontal number (4*a*) of the first H shaped piece (1*a*). Second, insert the opposite arm (10*c*) of the first plus shaped piece into the space (5*b*) located above the horizontal member (4*b*) of a second H shaped piece (1*b*) so that the first H shaped piece (1*a*) and the second H shaped piece (1*b*) extend from the first plus shaped piece (7*a*) in the same direction. Third, insert a first arm (10*a*') of or second plus shaped piece (7*b*) into the space (6*b*) located below the horizontal member (4*a*) of the first H shaped piece (1*a*).

The fourth step to assemble the cubic configuration (14) is to insert the opposite arm (10*c*') of the second plus shaped piece into the space (6*b*) below the horizontal member (4*b*) of the second H shaped member (1*b*). Fifth, insert a cubic clock piece into either of two open spaces (16) located between the first plus piece (7*a*) and the second plus piece (7*b*) between arms (10*b*) and (10*b*') and (10*d*) and (10*d*') respectively.

Figure 5:
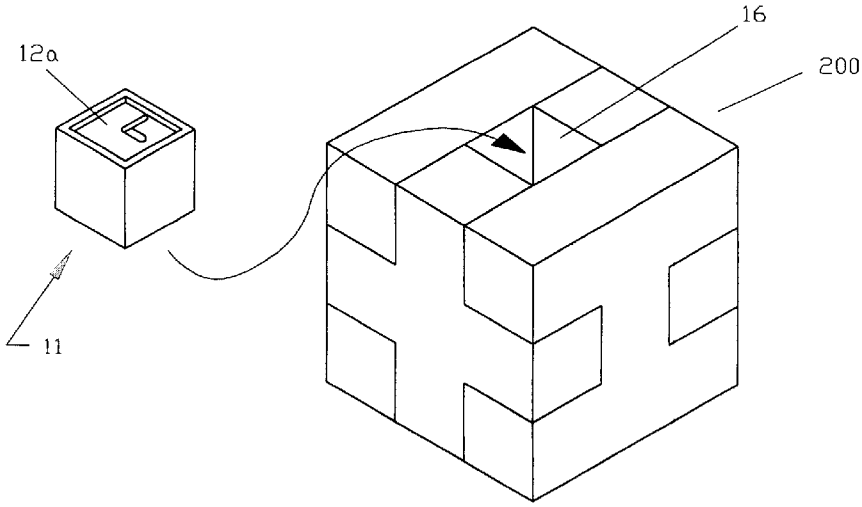
FIG. 5 is a perspective view of the cube configuration of the present invention without a cubic piece or product piece present in the open space.

FIG. 5 illustrates an assembled puzzle (200) in a cubic configuration. The cubic configuration shown in FIG. 5 further illustrates an open space (16) into which a cubic piece (11) may be placed. The cubic piece (11) is placed into the open space such that the face display (12*a*) is visible. The display may be any type of graphic or text that may serve advertising or information purposes.

Figure 6:
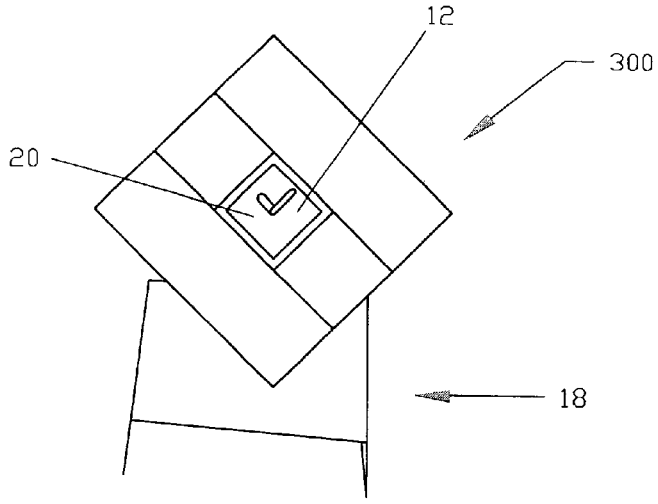
FIG. 6 is a perspective view of the cube configuration of the present invention ornamentally mounted upon a metal platform.

FIG. 6 illustrates the assembled puzzle (300) in a cubic configuration and placed upon a generally horizontal, flat platform (18). The platform shown in FIG. 6 may be composed of any aesthetic material such as metal or stained wood. The platform (18) may be decorated with textual or graphic information as well as a plurality of colors. Examples of information that may be placed upon the platform (18) include advertising, slogans, trademarks, and pictures. This provides not only an entertaining puzzle but also provides useful advertising space.

FIG. 7 illustrates the assembled puzzle (100) arranged in a W configuration. After the puzzle has been assembled, various products may be affixed to or placed upon the upper surface of the puzzle. FIG. 7 shows information cards (21) resting on and a cubic clock piece (20) affixed in the puzzle thereby creating an attractive product holder.

Each piece (1*a* and 1*b*, and 7*a* and 7*b*, and 11) may be composed of any material including an elastic rubber. An elastic rubber composition allows the pieces to interlock together due to surface friction between each of the pieces. The present invention can be assembled into a plurality of particular combinations without the need for accessories or assembly parts. After assembly of the pieces into a particular configuration, outer surface (17) of an assembled configuration may be decorated with textual or graphical information as well as a plurality of colors. Examples of particular configurations include a cube configuration (FIGS. 3A, 5 and 6), a W configuration (FIGS. 2A and 7), an M configuration (FIG. 2B), and a bird configuration(FIG. 1A).

Each particular configuration defines an open space for example (16) into which any cubic piece may be placed. The cubic piece (11) should be inserted into the open space (16) so that a face display (12) is visible.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such description of the invention. It is therefore contemplated that the appended claims will cover such modifications, alternatives, and equivalents that fall within the true spirit and scope of the invention.

I claim:

1. A combination puzzle and product holder comprising:

at least two H shaped pieces, said H shaped pieces comprising first and second vertical members perpendicularly connected by a horizontal member extending between said first and second vertical members thereby forming interlocking spaces in between said vertical members above and below said horizontal member;

at least two plus shaped pieces, each of said plus shaped pieces having a vertical plus member and two side members, said side members connected to opposite sides of said vertical plus member, said side members extending outwardly and perpendicularly from said vertical plus member thereby forming four separate arms, said arms interlockable with said interlocking spaces to join said H shaped and plus shaped pieces as an assembled puzzle; and at least one cubic piece, said cubic piece having at least one face display, said cubic piece interlockable within said interlocking spaces.

2. The combination of claim 1, wherein said assembled puzzle has a configuration selected from the group consisting of a bird configuration, a cube configuration, a W configuration and an M configuration.

3. The combination of claim 2, wherein each of said configurations each defines a cubic open space into which said cubic piece may be placed.

4. The combination of claim 1, wherein all of said pieces are of an elastic composition.

5. The combination of claim 4, wherein said all of said pieces interlock due to surface friction between said pieces.

6. The combination of claim 1, wherein selected H shaped pieces and selected plus shaped pieces are colored.

7. The combination of claim 2, wherein an outer surface of an assembled configuration has textual or graphic information thereon.

8. The combination of claim 2, further comprising a display platform.

9. The combination of claim 8, wherein said display platform may be composed of metal.

10. The combination of claim 1, wherein said cubic piece is a cubic clock piece.

11. The combination of claim 10, wherein said face display is a clock face.

12. The combination of claim 8, wherein said platform has textual or graphic information thereon.

13. The combination of claim 8, wherein said platform is colored.

14. The combination of claim 1, further comprising an information card affixed to said assembled puzzle.

15. A method for assembling a combination puzzle and product holder, comprising the steps of:

providing at least two H shaped pieces, said H shaped pieces comprising first and second vertical members perpendicularly connected by a horizontal member extending between said first and second vertical members thereby forming interlocking spaces in between said vertical members above and below said horizontal member;

further providing at least two plus shaped pieces, each of said plus shaped pieces having a vertical plus member and two side members, said side members connected to opposite sides of said vertical plus member, said side members extending outwardly and perpendicularly from said vertical plus member thereby forming four separate arms, said arms interlockable with said interlocking spaces;

further yet providing a cubic piece interlockable with said interlocking spaces;

interlocking a first of said arms of a first of said plus shaped pieces with a first interlocking space of a first of said H shaped pieces; and interlocking a second of said arms of a second of said plus shaped pieces with a second interlocking space of a second of said H shaped pieces.

16. A method for assembling a combination puzzle and product holder, comprising the steps of:

providing at least two H shaped pieces, said H shaped pieces comprising first and second vertical members perpendicularly connected by a horizontal member extending between said first and second vertical members thereby forming interlocking spaces in between said vertical members above and below said horizontal member;

further providing at least two plus shaped pieces, each of said plus shaped pieces having a vertical plus member and two side members, said side members connected to opposite sides of said vertical plus member, said side members extending outwardly and perpendicularly from said vertical plus member thereby forming four separate arms, said arms interlockable with said interlocking spaces;

further yet providing a cubic piece, said cubic piece comprising a cubic clock interlockable with said interlocking spaces;

inserting said cubic piece into said interlocking space located above said horizontal member of a first H shaped piece;

inserting a first arm of a first of said plus shaped pieces perpendicularly with said interlocking space located below said horizontal member of said first of said H shaped pieces;

inserting a second opposite arm of said first plus shaped piece perpendicularly with said interlocking space located above said horizontal member of a second of said H shaped pieces, said second H shaped piece extending in an opposite direction of said first H shaped piece;

inserting one of said arms of a second plus shaped piece perpendicularly with said interlocking space located below said horizontal member of said second H shaped piece, said second plus shaped piece extending in an opposite direction of said first plus shaped piece; and orienting said combination such that said second opposite arm of said first plus shaped piece is above said first arm of said first plus shaped piece.

17. The method of claim 15, further comprising the step of placing an information card upon said combination.

18. The method of claim 15, wherein said cubic piece is a cubic clock piece.

19. The method of claim 18, wherein said cubic clock piece has at least one face display.

* * * * *